US006626331B2

(12) United States Patent
Yenglin

(10) Patent No.: US 6,626,331 B2
(45) Date of Patent: Sep. 30, 2003

(54) GROUT SEALANT APPLICATOR

(76) Inventor: Floretta Beth Yenglin, 9904 Dusty Winds Ave., Las Vegas, NV (US) 89117

( * ) Notice: Subject to any disclaimer, the term of this patent is extended or adjusted under 35 U.S.C. 154(b) by 0 days.

(21) Appl. No.: 09/773,746

(22) Filed: Feb. 2, 2001

(65) Prior Publication Data

US 2001/0032862 A1 Oct. 25, 2001

(51) Int. Cl.[7] ..... B67D 3/00

(52) U.S. Cl. ..... 222/187; 222/158; 222/206; 222/571; 401/198

(58) Field of Search ..... 222/158, 568, 222/575, 206, 212, 187, 571; 401/198, 196; 132/111

(56) References Cited

U.S. PATENT DOCUMENTS

| | | | | | |
|---|---|---|---|---|---|
| 380,894 | A | * | 4/1888 | Homer | 206/1.9 |
| 3,010,613 | A | | 9/1961 | Stossel | |
| 3,189,223 | A | | 6/1965 | Mackel | |
| 3,308,993 | A | | 3/1967 | Bruno | |
| 3,985,271 | A | | 10/1976 | Gardner | |
| 4,027,789 | A | | 6/1977 | Dickey | |
| 4,730,751 | A | | 3/1988 | Mackles | |
| 4,878,599 | A | * | 11/1989 | Greenway | 222/575 |
| 5,248,071 | A | * | 9/1993 | Ray | 222/568 |
| 5,265,770 | A | * | 11/1993 | Matkovich et al. | 222/189 |
| 5,582,327 | A | * | 12/1996 | de Laforcade | 222/1 |
| 6,010,042 | A | * | 1/2000 | Boucher et al. | 222/510 |
| 6,021,930 | A | | 2/2000 | de Pous | |

* cited by examiner

*Primary Examiner*—Kevin Shaver
*Assistant Examiner*—Stephanie L Willatt
(74) *Attorney, Agent, or Firm*—Harry M. Weiss; Weiss, Moy & Harris, P.C.

(57) ABSTRACT

A tool designed to efficiently apply sealant to tile grout—it is a plastic, round bottle (4), with ounce indicator lines marked on the exterior (8); and a plastic nozzle (10) that tightly screws onto the bottle, via embedded threads inside the top of the bottle (16) and inside the base of the nozzle (18). Cellulose sponge (6 and 12) is fitted tightly inside the bottle (4) is fitted tightly inside the bottle (4) and nozzle (10); which controls the amount of sealant flow so that there is minimal dripping or waste of sealant. The applicator holds approximately 5 to 6 ounces of liquid grout sealant. The tip of the nozzle is marked (14) and gradated (14) so it can be cut with a razor to match the flow of sealant to the width of the grout. The application of sealant is controlled by gently applying pressure to the flexible bottle (4) and moving the tip at a 45 degree angle along the line of grout to be sealed.

3 Claims, 2 Drawing Sheets

Grout Sealant Applicator

Grout Sealant Applicator

Grout Sealant Applicator

GROUT SEALANT APPLICATOR

BACKGROUND OF THE INVENTION

Figure 1:
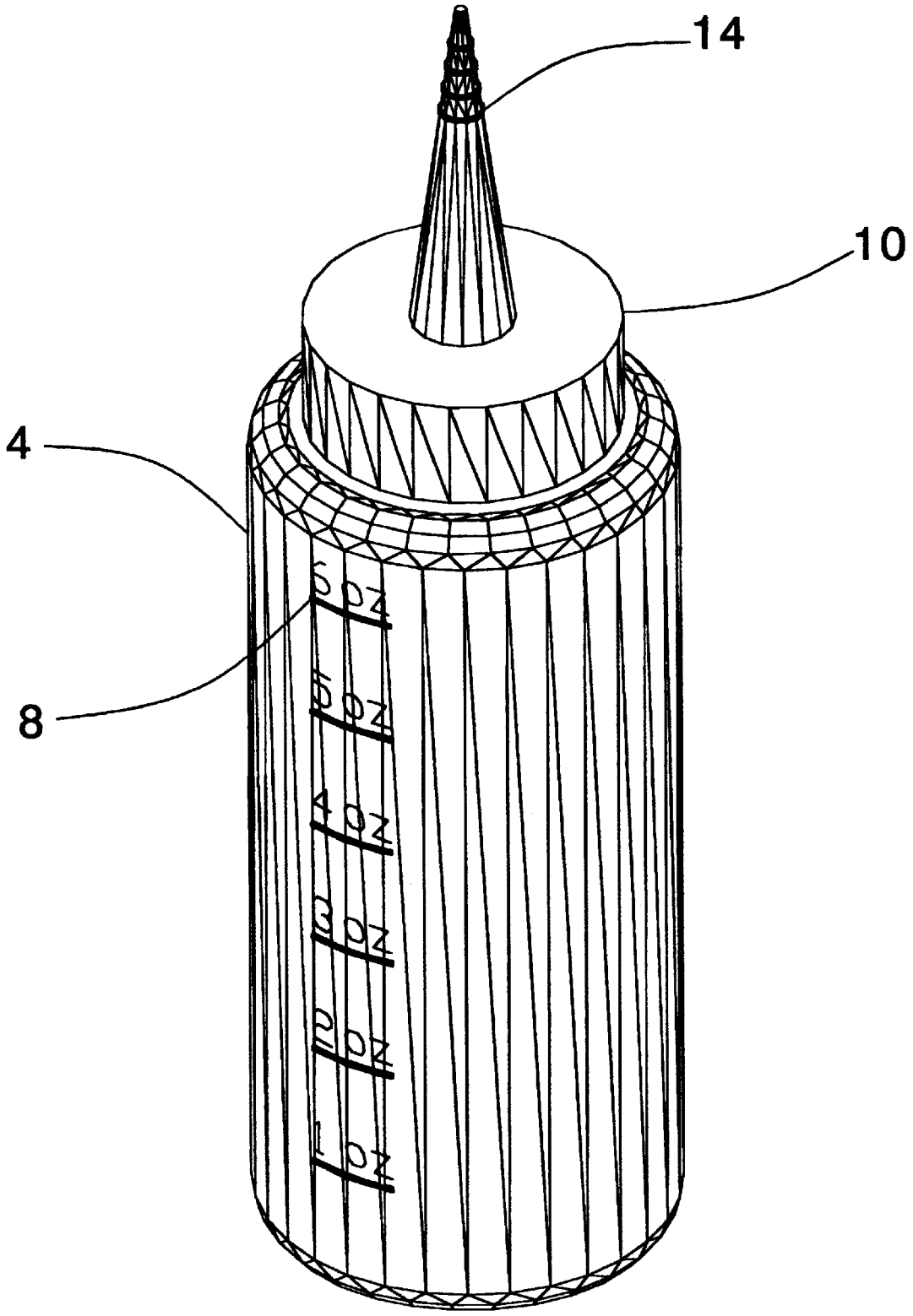

Field of the Invention for the Grout Sealant Applicator relates to a significantly improved method of applying sealant to tile grout.

BRIEF SUMMARY OF THE INVENTION

The remarkably simple Grout Sealant Applicator is specifically designed to apply grout sealant to tile grout. With this applicator the job is done in a manner that is more efficient than any other tool on the market in amount of time and money required to complete the sealing of applicator to grout. The applicator does so with the use of a main bottle with a nozzle attached, both containing sponge material. When the nozzle is cut the width of the grout, the sealant can be easily applied by squeezing the bottle, releasing sealant along the lines of grout.

BRIEF DESCRIPTION OF THE SEVERAL VIEWS OF THE DRAWING(S)

FIG. 1 shows Part 4, the main body of the applicator, round in design, and composed of flexible, plastic material; Part 8, the main fitted side of the applicator bottle that indicates the number of ounces of sealant in the bottle 4.; Part 10, a nozzle made of rigid plastic with embedded threads at its base to indicate amount of ounces of sealant in the bottle 4; and Part 14, indicator lines on the side of nozzle 14 that can be cut so the nozzle matches the width of the grout.

Figure 2:
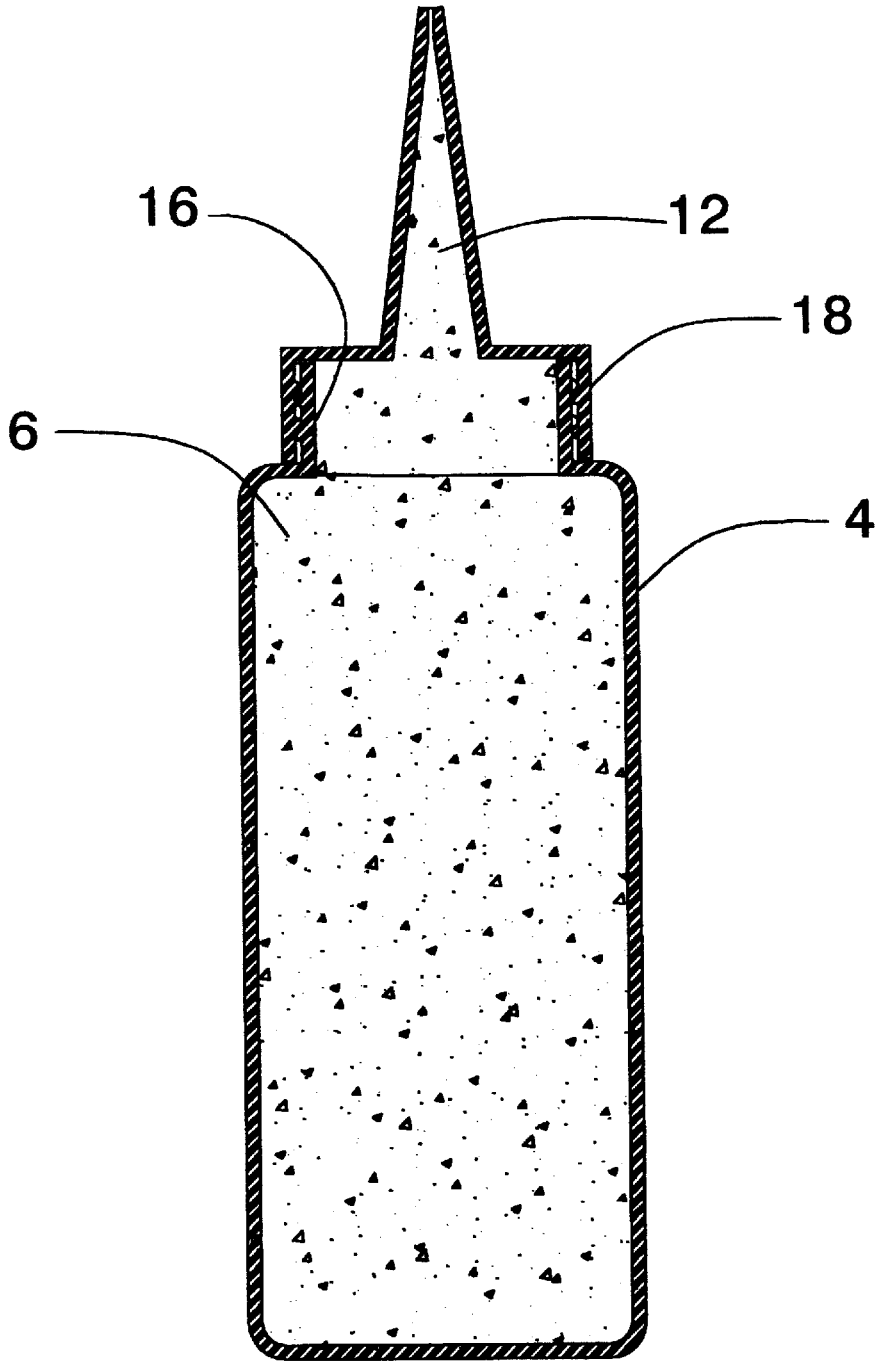

FIG. 2 shows Part 4, explained above; Part 6, the main fitted, cellulose sponge material that is fitted snugly in the main body; Part 16, the top of the bottle, that screws on to the main body of the bottle via Part 18, embedded threads at the base of the nozzle

DETAILED DESCRIPTION OF THE INVENTION

The Grout Sealant Applicator specifically consists of the following main parts:

The main, flexible plastic bottle: 12.50 mm tall and 5 mm in diameter at the base.

The rigid, plastic nozzle: 5.62 mm tall and 4.08 in diameter at the base.

Fitted cellulose sponge material fitted snugly in the main body and nozzle.

Following the drawing figures, FIG. 1 and FIG. 2, the following 9 steps can be applied in the following manner in describing the process of using the Grout Sealant Applicator:

1. Unscrew the nozzle 10 from the main, applicator bottle 4 where the embedded threads inside the base of the nozzle 18 screw on to the embedded threads at the top of the bottle 16.
2. Fill the bottle 4 with your choice of grout sealant to approximately and safely between 5 or 6 oz. indicator line and the very top of the unscrewed body of the bottle. (If you fill sealant to a higher level in the bottle it can be significantly less controllable when initially being applied to the tile surface.)
3. Again, tightly screw the nozzle 10 onto the bottle 4.
4. Determine the indicator line at the top of the nozzle 14 that best fits the grout width. Cut off the nozzle 10 tip to the chosen line 14 with a razorblade.
5. Place the bottle 4 at about a 45 degree angle and gently lay the tip of the nozzle 10 on the grout.

6. Gently apply pressure to the bottle 4 and move the bottle 4 along the line of the grout, releasing sealant all along the way.
7. Refill the bottle 4 as needed. The main bottle and nozzle are repeatedly filled with sealant, until the sealant is completely absorbed by the sponge safely above the 5 or 6 oz. mark. Each time the bottle and nozzle are completely emptied of sealant, the bottle and nozzle are again filled with enough sealant (to the 6 oz. mark) to continue the job.
8. Make as many applications as the sealant manufacturer requires.
9. When the job is completed you can easily discard the inexpensive Grout Sealant Applicator if you choose.

The reasons that make the Grout Sealant Applicator unique and patentable are that the following qualities are embodied in one, rather than several useful tools; and, in combining these tools, it effectively and efficiently applies grout sealant:

The sponge material, fitted inside the plastic body and the nozzle of the applicator, absorbs the liquid sealant; until you are able to, by applying gentile pressure, begin to squeeze the liquid to release the liquid from the sponge. The sponge absorbs, holds and controls the sealant and minimizes the flow of sealant which also minimizes the sealant from being released too quickly and, so, wasting any sealant.

The plastic nozzle can be cut to create a minimum flow of sealant that is custom designed to fit the width of grout.

The applicator is so inexpensive to manufacture that even at a low sales price, it is extremely cost effective. Therefore, it can also be comfortable disposed of after a grout sealing job is complete.

The applicator enables a grout sealant job to be completed in 25% to 50% less time and less expense than does any other tool available (depending on which tool you are comparing it to.

Even an unsteady and/or unskilled hand can successfully seal grout with this applicator since it is so easy to learn and use.

The applicator can be made in different colors.

I claim:

1. A grout sealant applicator device comprising, in combination:

a bottle having a cellulose sponge type material located within said bottle;

grout sealant fluid located within said bottle, said cellulose sponge type material having said grout sealant Fluid absorbed therein; and an elongated nozzle having an open end portion coupled to an open end portion of said bottle, said elongated nozzle having a hollow portion and also having a substantially pointed grout sealant dispensing open end portion adapted to dispense said grout sealant fluid onto grout, said cellulose sponge type material having said grout sealant fluid absorbed therein also located within said hollow portion of said elongated nozzle, said cellulose sponge type material located within said bottle and also located within said hollow portion of said elongated nozzle adapted to control flow of said grout sealant fluid out of said bottle onto grout.

2. The grout sealant applicator device of claim 1 wherein said elongated nozzle having means located on an exterior portion of said elongated nozzle for permitting cutting off a portion of said substantially pointed grout sealant dispensing open end portion of said elongated nozzle to match various widths of grout to permit said grout sealant fluid to better flow onto various widths of grout.

3. The grout sealant applicator device of claim 2 including means located on an exterior portion of said bottle for providing an indication of the amount of ounces of said grout sealant fluid located within said bottle.

* * * * *